US007272872B2

(12) United States Patent
Choi

(10) Patent No.: US 7,272,872 B2
(45) Date of Patent: Sep. 25, 2007

(54) VACUUM CLEANER WITH ARTICULATED SUCTION PORT ASSEMBLY

(75) Inventor: Keon-soo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 535 days.

(21) Appl. No.: 10/851,321

(22) Filed: May 24, 2004

(65) Prior Publication Data

US 2005/0120512 A1 Jun. 9, 2005

(30) Foreign Application Priority Data

Dec. 5, 2003 (KR) ..... 10-2003-0088200

(51) Int. Cl.
*A47L 9/02* (2006.01)

(52) U.S. Cl. ..... 15/415.1; 15/327.7

(58) Field of Classification Search ..... 15/327.7, 15/415.1; 285/7; *A47L 5/36, 9/02, 9/24*
See application file for complete search history.

(56) References Cited

U.S. PATENT DOCUMENTS

| | | | | |
|---|---|---|---|---|
| 1,533,368 | A | 4/1925 | Berg | |
| 4,537,424 | A * | 8/1985 | Maier et al. | 285/7 |
| 6,553,613 | B2 * | 4/2003 | Onishi et al. | 15/351 |

FOREIGN PATENT DOCUMENTS

| | | | |
|---|---|---|---|
| DE | 40 37 432 | A1 | 8/1991 |
| EP | 0 976 358 | A3 | 2/2000 |
| EP | 1 393 221 | A1 | 3/2004 |
| GB | 2 393 383 | A | 3/2004 |
| JP | 57-3616 | | 9/1982 |
| JP | 11-206654 | * | 8/1999 |
| JP | 11-239553 | | 9/1999 |
| JP | 2000-225079 | * | 8/2000 |
| JP | 2000-354573 | | 12/2000 |
| JP | 2001-149283 | | 6/2001 |
| JP | 2003-153833 | | 5/2003 |

(Continued)

OTHER PUBLICATIONS

Combined Search and Examination Report under Sections 17 and 18(3) dated Nov. 2, 2004.

(Continued)

*Primary Examiner*—Theresa T. Snider
(74) *Attorney, Agent, or Firm*—Blank Rome LLP

(57) ABSTRACT

A suction port assembly of a vacuum cleaner is connected with a cleaner body by an extended flow passage and draws in air and dust from a surface being cleaned when the cleaner is in operation. The suction port assembly includes a suction head having a suction hole formed at a bottom surface opposite to the surface being cleaned. A first connection member extends from one side of the suction head. A second connection member rotatably connects at one end to an exit end of the first connection member and rotates about a first axis to move upwardly and downwardly with respect to the suction head, and at the other end is connected with the extended flow passage. A third connection member engages the second connection member with one end rotatable about a second axis substantially perpendicular to the first axis, and the other end disengageably connected to the extended flow passage.

12 Claims, 6 Drawing Sheets

FOREIGN PATENT DOCUMENTS

| | | |
|---|---|---|
| KR | 20-0201777 | 11/2000 |
| WO | WO 84/03429 | 9/1984 |

OTHER PUBLICATIONS

Russian Patent Office, Office Action issued in connection with the corresponding application No. 2004118826.

Korean Intellectual Property Office, Official Action issued Oct. 25, 2005 with respect to Korean Patent Application No. 2003-88200 filed on Dec. 5, 2003.

Chinese Patent Office, Office Action Issued Mar. 10, 2006 with respect to Chinese Patent Application No. 200410061964.3 filed Jun. 29, 2004.

Japanese Patent Office, Office Action issued Oct. 17, 2006, with respect to Japanese Patent Application No. 2004-153625 filed May 24, 2004.

German Patent Office, Office Action issued Jan. 9, 2007, with respect to German Patent Application No. 102004031373.3 filed Jun. 29, 2004.

* cited by examiner

VACUUM CLEANER WITH ARTICULATED SUCTION PORT ASSEMBLY

RELATED APPLICATION

This application claims priority to copending Korean Patent Application No. 2004-88200 filed Dec. 5, 2003, in the Korean Intellectual Property Office, which is incorporated herein by reference in its entirety.

CROSS-REFERENCE TO RELATED APPLICATION

This application is related to copending application entitled "Suction Brush Assembly Having Rotation Roller Sweeping Dust" (Korean Application No. 2002-11240, filed Mar. 4, 2002).

FIELD OF THE INVENTION

The present invention relates to a vacuum cleaner, and more particularly, to a suction assembly of a vacuum cleaner which draws in air and contaminants from a surface being cleaned.

BACKGROUND OF THE INVENTION

Conventional vacuum cleaners generally draw in air and dust from a surface being cleaned by utilizing a suction force generated by a vacuum generator of the vacuum cleaner body. Referring to FIG. 1, a general conventional vacuum cleaner 100 comprises a cleaner body 110 housing a vacuum generator (not shown) therein, an extended flow passage 120 having at least one of an extension pipe 125 and an extension hose 121, connected in fluid communication with the cleaner body 110, and a suction port assembly 130 formed at an end of the extended flow passage 120 to draw in air and the dust from the surface being cleaned.

As seen in FIG. 2, the suction port assembly 130 has a suction head 131 and a suction port 132 extending therein. The suction port assembly 130 is movable along the surface being cleaned during cleaning operation. An articulated portion 135 shaped as a neck connects the suction head 131 in fluid communication to the extended flow passage 120. The extended flow passage 120 is movably connected with the suction head 131 which is lifted up by the articulated portion 135.

A conventional articulated portion 135, as seen in FIG. 1, includes a first connection hole 136 for pivotal connection with the rear side of the suction head 131, and a second connection hole 137 for removable connection with the extension pipe 125 of the extended flow passage 120. The first connection hole 136 is formed in a square shape to guide the air from the suction port 132 towards the extended flow passage 120 even when the articulated portion 135 is pivoted at an angle with respect to the suction head 131.

However, the conventional articulated portion 135 of the suction port assembly 130 only allows pivotal movement between the suction head 131 and the extended flow passage 120 in the lifting direction 'a' (FIG. 1) with respect to the surface being cleaned, covering only a limited range of cleaning area. For example, the conventional vacuum cleaner 100 often has difficulty in cleaning crevices or corners of a room.

Additionally, because the first connection hole 136 of the articulated portion 135 is formed in square shape, as shown in FIG. 2, the pivotal movement of the articulated portion 135 is limited to within a predetermined angle θ so that the first connection hole 136 is not exposed to the outside of the suction head 131. If the articulated portion 135 is moved more than the predetermined angle θ, the bottom surface of the suction head 131 is lifted apart from the cleaning surface, thereby reducing cleaning efficiency. Even when the articulated portion 135 is moved within the predetermined angle θ, suction efficiency is often reduced due to the partial blocking of the first connection hole 136 by inner structures of the suction head 131.

SUMMARY OF THE INVENTION

Accordingly, on object of the present invention is to provide a suction port assembly of a vacuum cleaner, which has an improved articulated portion enabling a higher efficiency cleaning operation and facilitating rotation of the extended flow passage with respect to the suction head.

The foregoing object is basically attained by providing a suction port assembly of a vacuum cleaner including a suction head that has a suction hole formed at a bottom surface opposite to the surface being cleaned; one or more first connection members extended from one side of the suction head; and a second connection member rotatably connected at one end to an exit end of the first connection member rotating about a first axis with respect to the suction head, and a second end connected with the extended flow passages. Air is drawn in through the suction hole during the vacuum cleaning operation and passes through the first connection member and the second connection member and enters into the extended flow passages.

Accordingly, the rotational range of the extended flow passage about the first axis with respect to the suction head is extended.

A third connection member can be provided which engages the second connection member in fluid communication with the extended flow passages. The third connection member rotates with respect to the second connection member about a second axis which is substantially perpendicular to the first axis.

Because the extended flow passage is rotatable with respect to the suction head about a plurality of axes, a wide range of cleaning area including crevices and corners can be cleaned efficiently.

The second axis is substantially parallel to the normal line of the surface being cleaned, when the second connection member is substantially parallel to the surface being cleaned.

The second connection member includes a first connection opening connected in fluid communication with the suction hole at the end opposite to the end which is connected with the third connection member. A first connection boss extends from the inner sidewall of the second connection member toward the first connection opening, and has a screw-piercing hole at a lower end thereof. The third connection member includes an upper wall that has a second connection opening sealingly closed by the first connection opening when the second and third connection members are engaged with each other. A hole is located adjacent to the second connection opening and a second connection boss extends from the inner side of the upper wall toward the inside of the third connection member. A fastener seating hole receives a screw fastener that engages the screw-piercing hole.

A stopper protrusion and a stopper hole are formed on an end of the first connection boss and on an upper surface of the upper wall, respectively. The stopper protrusion and the stopper hole face each other when the third connection member is rotated to a predetermined position with respect to the second connection member.

A coil spring is further provided in the fastener seating hole of the second connection boss. The coil spring is supported at its upper end by the upper wall of the third connection member, and supported by the screw fastener at its lower end, and resiliently urges the upper wall of the third connection member towards the second connection member.

The upper wall of the third connection member is angled at a predetermined height with respect to the other upper surfaces of the third connection member, and upon engagement between the second and third connection members, the upper wall is inserted in the first connection opening to block the first connection opening from the outside.

Accordingly, relative rotation of the second and the third connection members can be resiliently controlled.

The suction head includes a pair of suction holes in the bottom surface thereof which oppose the surface being cleaned, and a connection recess disposed in the bottom surface in abutment with the pair of suction holes.

The suction head includes a pair of inner flow passages formed in the suction head to connect the pair of suction holes to the pair of first connection members. The pair of inner passages are isolated from each other in the suction head.

The suction head includes one or more suction holes formed along an edge of the suction head in fluid communication with the connection recess.

By drawings contaminants in through the side of the suction head in addition to the front, contaminants, even in the crevice and corner areas, can be efficiently cleaned.

BRIEF DESCRIPTION OF THE DRAWINGS

The above aspects and features of the present invention will be more apparent by the description below of the present invention with reference to the accompanying drawings.

DETAILED DESCRIPTION OF THE PREFERRED EMBODIMENTS

The present invention will be described in greater detail with reference to the accompanying drawings.

The matters defined in the description, such as a detailed construction and elements, are provided only to assist in a comprehensive understanding of the invention. Thus, it is apparent that the present invention can be carried out without such defined matters. Also, well-known functions or constructions are not described in detail.

Figure 3:
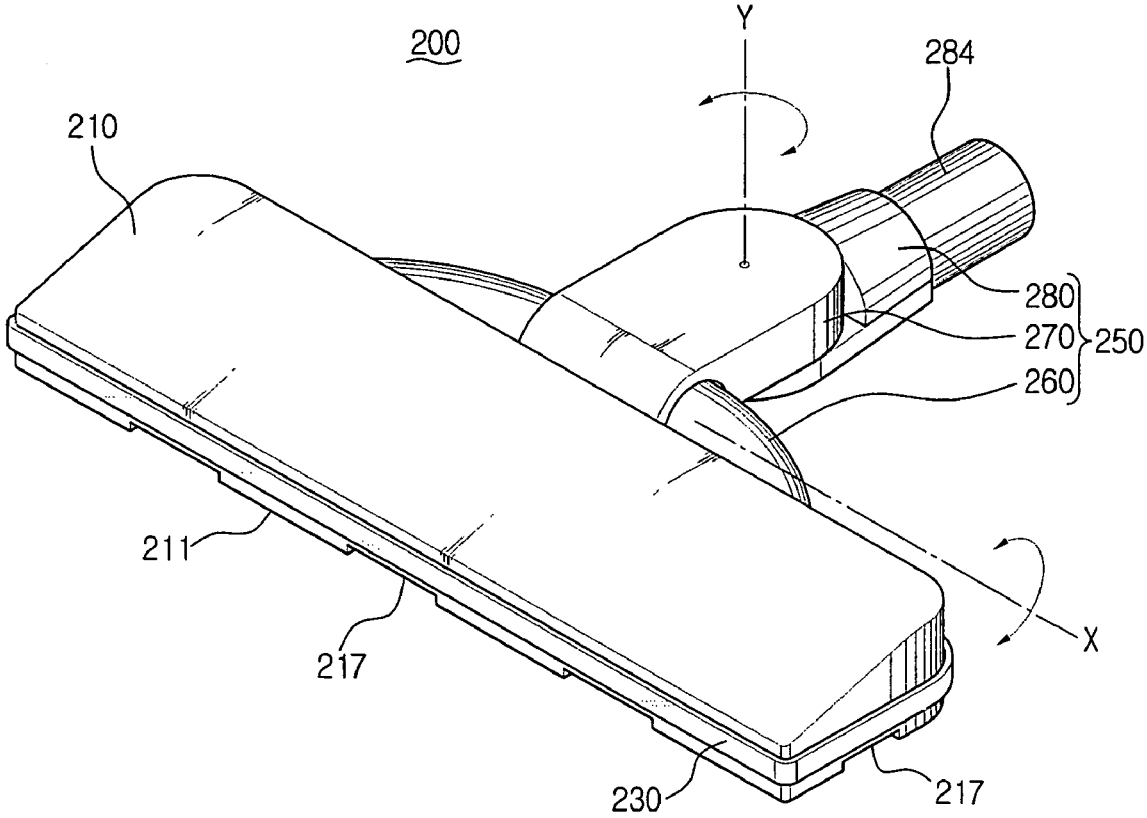
FIG. 3 is a perspective view of a suction port assembly according to an embodiment of the present invention.
Figure 4:
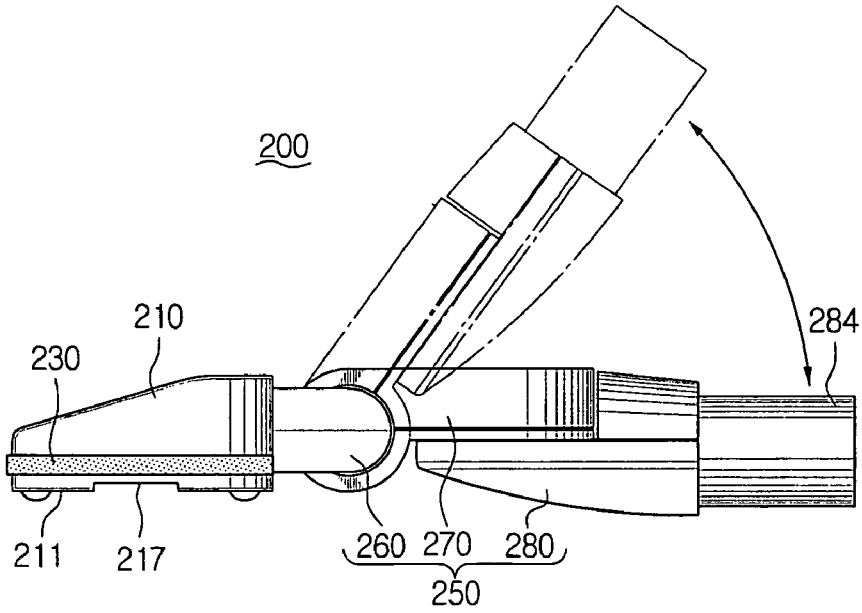
FIG. 4 is a side elevational view of the suction port assembly illustrated in FIG. 3, showing the assembly moving between positions.

Referring to FIGS. 3 and 4, a suction port assembly 200 of a vacuum cleaner according to an embodiment of the present invention includes a suction head 210 and an articulated portion 250.

Figure 5:
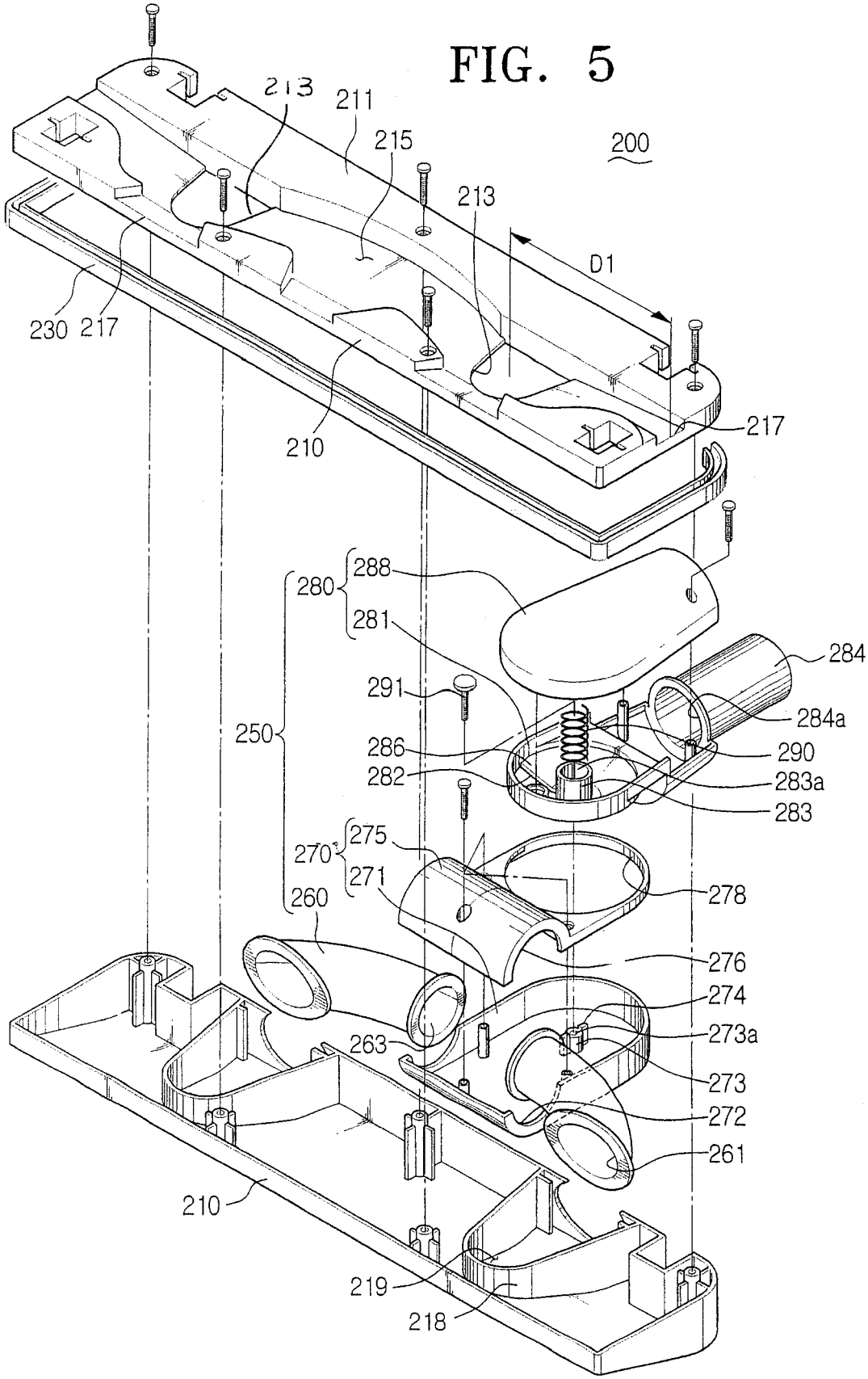
FIG. 5 is an exploded perspective view of a bottom side of a suction head of the suction port assembly illustrated in FIG. 3.

The suction head 210 draws in dust from a surface being cleaned, and as shown in FIG. 5, includes a pair of spaced suction holes 213, an inner partition 218, a connection recess 215, and a suction groove 217. A member 230 is a bumper which decreases impact of the suction head 210 with obstacles during operation of the vacuum cleaner.

The pair of spaced suction holes 213 are located in the bottom surface 211 of the suction head 210. Because there are a pair of suction holes 213, rather than a single hole, a distance D1 between the suction groove 217 at the side of the suction head 210 and the suction holes 213 is reduced, thereby increasing cleaning efficiency.

The connection recess 215 is formed by the bottom surface of the suction head 210 between the suction holes 213. Accordingly, a suction area covered by the suction holes 213 increases to the range of the connection recess 215.

A plurality of suction grooves 217 are dispersed along the side of the suction head 210, in abutment with the connection recess 215. Contaminants are drawn in through the suction grooves 217 and passed through the connection recess 215 and guided to the suction holes 213. The suction grooves 217 draw in both the contaminants on the surface being cleaned and also the contaminants piled in front or to the sides of the suction head 210, thereby improving cleaning efficiency.

The inner partition 218 is formed inside the suction head 210 and defines in the interior of the suction head 210 inner passages 219 which connect the suction holes 213 to a first connection member 260. Air drawn in through the suction holes 213 can flow to a second connection member 270. Flow deterioration of the air drawn in through the suction holes 213 is prevented in the suction head 210, thereby improving efficiency.

The articulated portion 250 connects the suction head 210 with the extension pipe 125 (FIG. 1) and allows the suction head 210 to rotate about a plurality of axes X and Y (FIG. 3). As shown in FIGS. 3 and 4, the articulated portion 250 rotates about the first axis X with the suction head 210, and rotates about the second axis Y in a transverse direction with respect to the suction head 210. The articulated portion 250 includes the first and the second connection members 260 and 270, and a third connection member 280.

Figure 6:
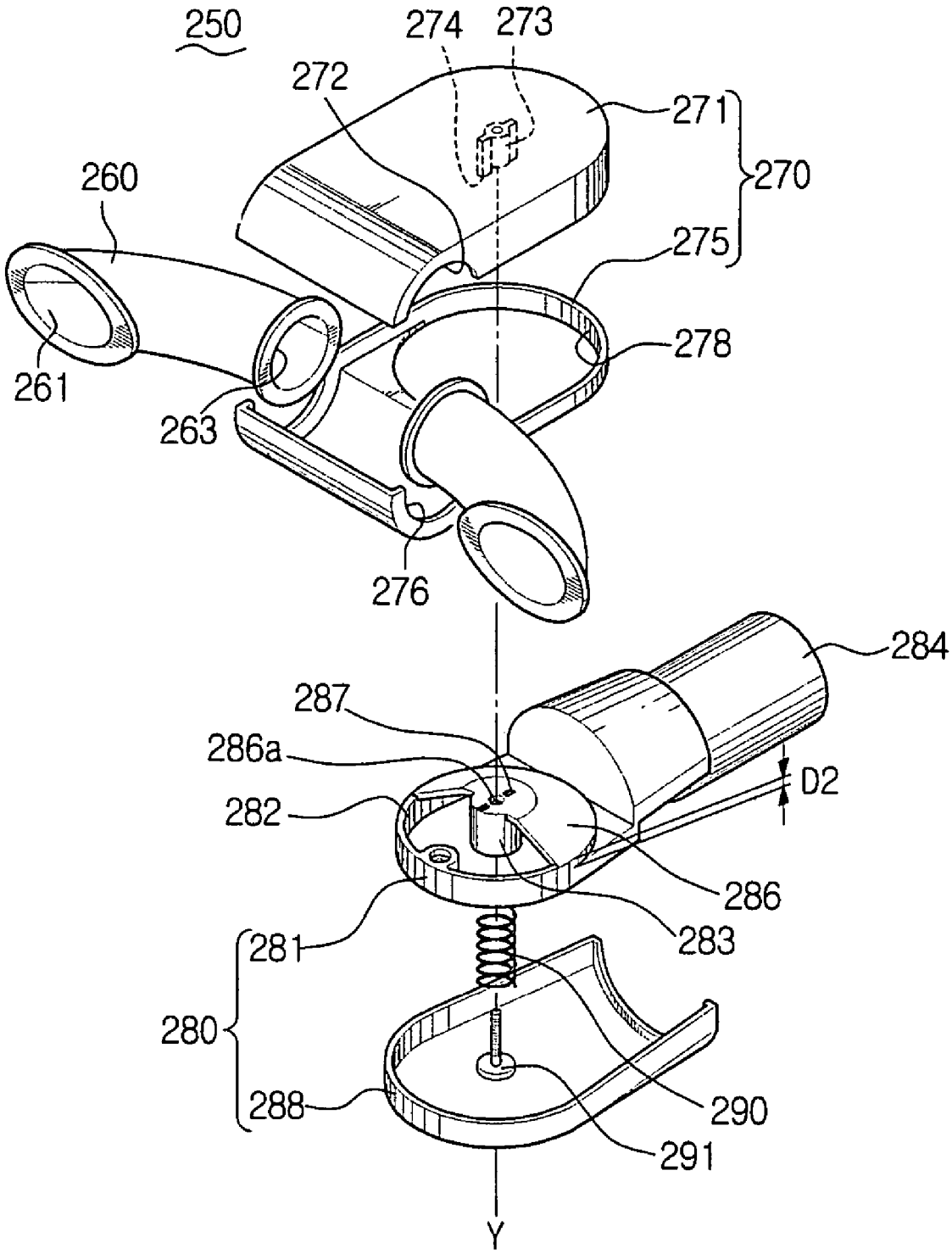
FIG. 6 is an exploded perspective view of an articulated portion of the suction port assembly illustrated in FIG. 3.

Referring to FIGS. 5 and 6, one or more of the first connection members 260 extend rearwardly from the suction head 210. Each of the first connection members 260 has an entrance end 261 connected to the inner passage 219 defined inside the suction head 210, and a tubular exit end 263 which is connected to the second connection member 270. The number or shape of the first connection member 260 can be modified as long as the inner passages 219 are connected with the second connection member 270. Preferably, a pair of the first connection members 260 are formed in register with the pair of suction holes 213. The tubular exit ends 263 of each of the first connection members 260 are formed opposite one another such that the second connection member 270 is engaged with the first connection members 260 in a rotatable manner about the first axis X.

One end of the second connection member 270 is connected to the tubular exit ends 263 of the first connection members 260 in a rotatable manner with respect to the first axis X (FIG. 3), while the other end thereof is removably connected to the extension pipe 125 (FIG. 1) through the third connection member 280. The first axis X is substantially parallel with respect to the length of the suction head 210 which is substantially perpendicular with respect to the advancing direction of the suction head 210, and also parallel with respect to the surface being cleaned. Accordingly, the articulated portion 250 is movable up and down with respect to the suction head 210. The second connection member 270 includes a first cover 271 and a second cover 275. The second connection member 270 also has a space in which the air from the first connection members 260 can flow when the first and the second covers 271 and 275 are connected with each other. The first cover 271 constitutes the upper wall of the second connection member 270. The first cover 271 also has recesses 272 formed on opposite sidewalls of the first cover 271 to accommodate a part of each of the tubular exit ends 263 of the first connection members 260, and a first connection boss 273 extends from the inner sidewall of the first cover 271 opposite to the third connection member 280. The first connection boss 273 has a screw-threaded hole 273*a* approximately at a center portion thereof, and a stopper protrusion 274 that extends from the outer circumference at the boss 273.

The second cover 275 forms the lower wall of the second connection member 270. The second cover 275 includes recesses 276 formed oppositely on opposite sidewalls of second connection member 270 to accommodate a part of each of the tubular exit end 263 of the first connection members 260. When the first and the second covers 271 and 275 are engaged with each other, with the first connection members 260 interposed there between, the recesses 272 and 276 form entrance ends which correspond to the tubular exit ends 263 of the first connection members 260. The second cover 275 has a first connection opening 278 at its other end near the third connection member 280, which enables rotation of the second cover 275 about the second axis Y with the third connection member 280, and is in fluid communication with a second connection opening 282 of the third connection member 280. When the first and second covers 271 and 275 are engaged with each other, the first connection boss 273 is disposed within the first connection opening 278.

Figure 1:
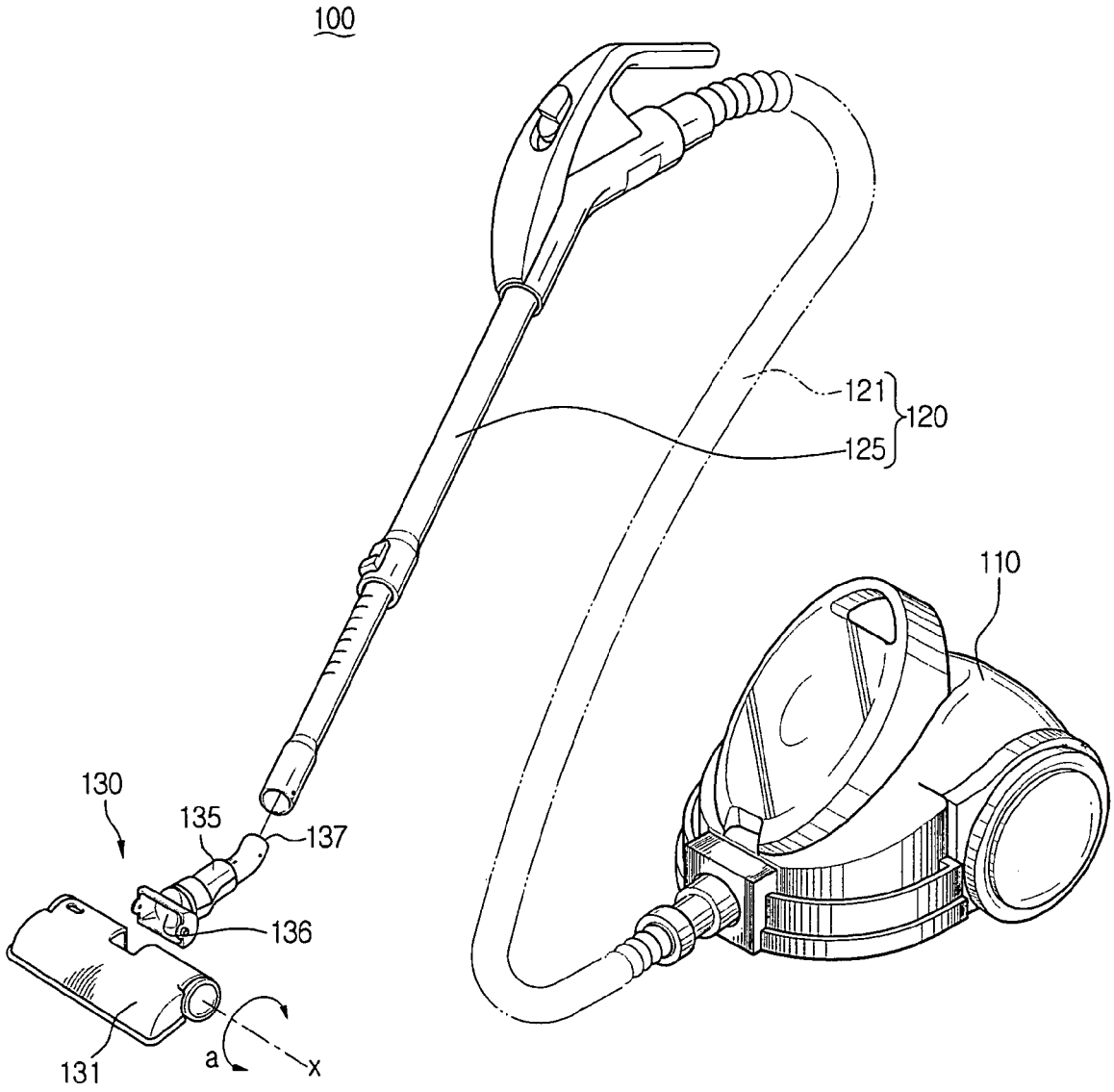
FIG. 1 (PRIOR ART)
FIG. 1 is an exploded perspective view of a conventional vacuum cleaner.
Figure 2:
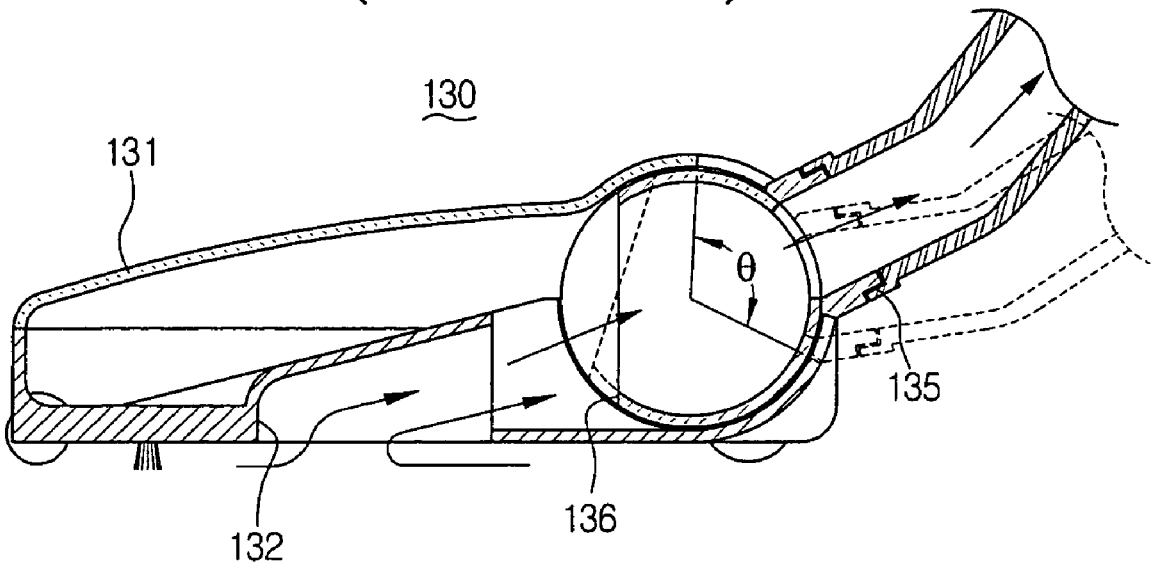
FIG. 2 (PRIOR ART)
FIG. 2 is a side elevational view in section illustrating a conventional suction head of the conventional vacuum cleaner illustrated in FIG. 1, showing the assembly in operation.
Figure 7:
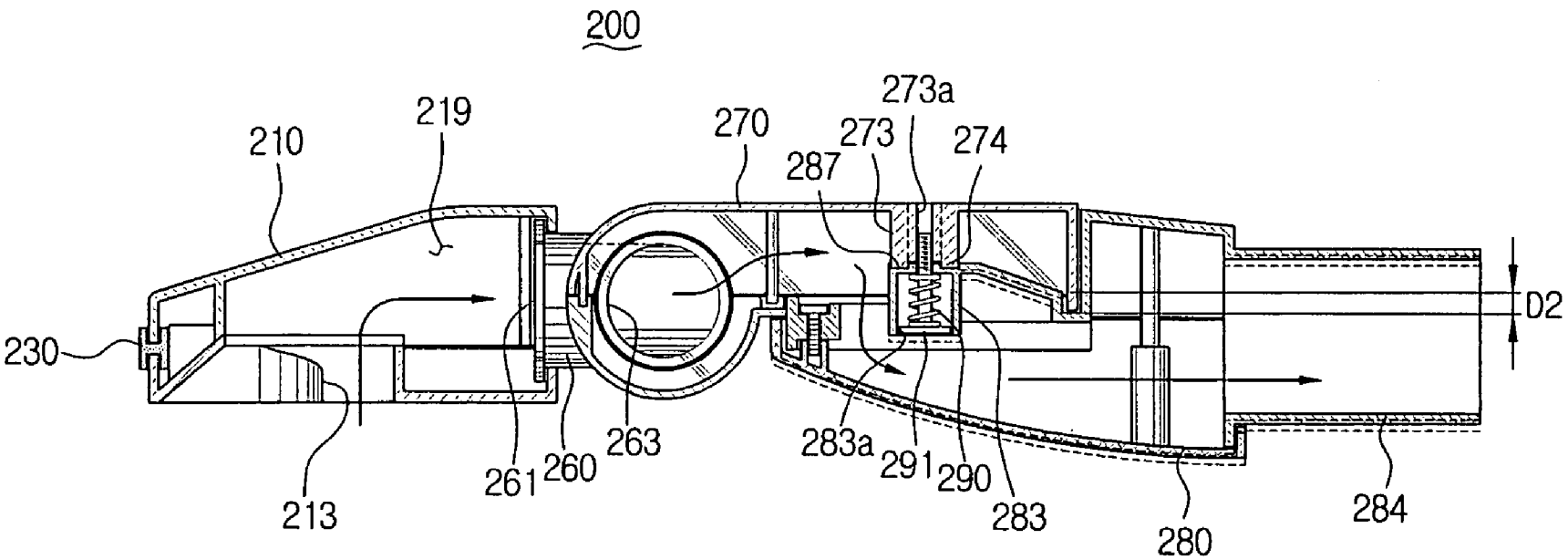
FIG. 7 is a side elevational view in section of the suction port assembly illustrated in FIG. 3, showing the assembly in operation.

The third connection member 280 includes a third cover 281 and a fourth cover 288. The third connection member 280 is rotatably connected about the second axis Y with respect to the second connection member 270 at one end, and disengageably connected with the extension pipe 125 (FIG. 1) of the extended flow passage 120 (FIG. 1) at the other end. An upper wall 286 is formed on one end of the third cover 281, in rotatable engagement with the second connection member 270 via the first connection opening 278 of the second connection member 270, and a tubular connector 284 is disengageably connected with the extension pipe 125. When the third and the fourth covers 281 and 288 are engaged with each other, the entrance end 284*a* of the tubular connector 284 is blocked and a space is defined in the third connection member 280 through which air moves. When the second and third connection members 270 and 280 are engaged with each other, the second connection opening 282 is formed in the upper wall 286, in connection with the first connection opening 278. As shown in FIG. 7, air is drawn in through the suction holes 213 of the suction head 210 and passes through the inner passages 219 in the suction head 210, the first and second connection members 260 and 270, and flows into the third connection member 280. From the third connection member 280 air flows to the extended flow passage 120 (FIG. 1) through the tubular connector 284, and into the cleaner body 110 (FIG. 1). A second connection boss 283 extends downwardly from the upper wall 286, corresponding to the first connection boss 273 of the second connection member 270. A screw-piercing hole 286*a* (FIG. 6) is formed approximately at the center of the upper wall 286 which opposes the upper end of the second connection boss 283. The screw-piercing hole 286*a* aligns with the fastening hole 273*a*. The second connection boss 283 has a fastener seating recess 283*a* on which a screw fastener 291 is seated. The second and third connection members 270 and 280 are engaged by inserting the screw fastener 291 into the fastener seating recess 283*a*, through the screw-piercing hole 286*a* and engages the threads of screw-threaded hole 273*a*. The screw fastener 291 and the screw-threaded hole 273*a* are formed such that a gap is defined therebetween, allowing the second and third connection members 270 and 280 to rotate smoothly with respect to each other.

The articulated portion 250 restricts relative rotation of the second and third connection members 270 and 280 about the second axis Y at a predetermined position. This prevents the inconvenience of the suction head 210 rotating freely about the second axis Y. To this end, the second and third connection members 270 and 280 each have a stopper protrusion 274, a stopper hole 287 and a spring 290.

As shown in FIG. 5, the stopper protrusion 274 extends from the outer circumference of the first connection boss 273. The stopper hole 287 is, as shown in FIG. 6, located in the upper surface of the upper wall 286 of the third connection member 280 adjacent to the second connection opening 282 and the screw-piercing hole 286*a*. Both the stopper protrusion 274 and the stopper hole 287 face each other when the third connection member 280 rotates with respect to the second connection member 270 in parallel relation with respect to the advancing direction of the suction head 210. When the stopper protrusion 274 and the stopper hole 287 face each other, the spring 290 urges upwardly the third connection member 280 for insertion into the stopper hole 287. The spring 290 is disposed in the fastener seating recess 283*a* of the second connection boss 283, and compressed toward the upper wall 286 by the screw fastener 291 which is engaged in the screw-threaded hole 273*a*. In order to prevent air leakage due to the movement of the third connection member 280 through the junctions between the second and third connection members 270 and 280, the upper wall 286 extends beyond the upper surface of the third connection member 280 by a predetermined distance D2 (FIG. 6). The upper wall 286 of the third connection member 280 is inserted in the second screw-piercing hole 286*a* when the second and third connection members 270 and 280 are engaged with each other, and the third connection member 280 is moved within the predetermined distance D2 as the height of the upper wall 286 allows.

In the suction port assembly 200, the first connection members 260 are depicted as extending rearwardly from the suction head 210. However, other variations are also possible. For example, the first connection members 260 can extend upwardly from the suction head 210, and can be formed in tubular or duct shape.

Because the suction head 210 is rotatably connected to the extension pipe 125 in a plurality of directions, a wide range of areas including crevice and corner areas can be easily cleaned.

Additionally, because the upward and downward rotation of the suction head 210 is smoother, the operator can perform cleaning operation with various, convenient postures. Also, suction degradation in association with the rotation angle of the suction head 210 is prevented.

Also, since the vacuum cleaner can collect contaminants pushed by the movement of the suction head 210 to the crevice areas, for example, through the suction holes, a higher cleaning efficiency is obtained.

The present teaching can be readily applied to other types of apparatuses. Also, the description of the present invention is intended to be illustrative, and not to limit the scope of the claims, and many alternatives, modifications, and variations will be apparent to those skilled in the art.

What is claimed is:

1. A suction port assembly of a vacuum cleaner, the suction port assembly being connected in fluid communication with a cleaner body through one or more extended flow passages which include at least one of an extension pipe and an extension hose, the suction port assembly comprising of:

a suction head having a suction hole formed at a bottom surface;

at least one first connection member extending from one side of the suction head;

a second connection member rotatably connected at one end to an exit end of the first connection member and rotatable about a first axis to move upwardly and downwardly with respect to the suction head, and the other end of the second connection member being connected with the extended flow passage; and a third connection member engaging the second connection member with the extended flow passage being in fluid communication therewith, whereby the third connection member rotates with respect to the second connection member about a second axis which is substantially perpendicular to the first axis, and the second connection member including a first connection opening connected in fluid communication with the suction hole and located at the end which is connected with the third connector member, and a first connection boss extending from an inner sidewall of the second connection member toward the first connection opening, the first connection boss having a screw piercing hole at a lower end thereof, wherein air is drawn in through the suction hole during the vacuum cleaning operation, passes through the first connection member and the second connection member and into the extended flow passage.

2. The suction port assembly of claim 1, wherein the second axis is substantially parallel to a normal line of a surface being cleaned, when the second connection member is substantially parallel the surface being cleaned.

3. The suction port assembly of claim 2, wherein the third connection member includes an upper wall having a second connection opening sealingly closed when the second and third connection members are engaged with each other, and a hole located adjacent to the second connection opening to oppose the screw-piercing hole; and a second connection boss extends from an inner side of the upper wall toward an inside of the third connection member, and has a fastener seating hole for receiving a screw fastener that engages the screw-piercing hole.

4. The suction port assembly of claim 3, wherein a stopper protrusion and a stopper hole are formed on an end of the first connection boss and an upper surface of the upper wall, respectively, and the stopper protrusion and the stopper hole face each other when the third connection member is rotated to a predetermined position with respect to the second connection member.

5. The suction port assembly of claim 4, wherein a coil spring is disposed in the fastener seating hole of the second connection boss, the coil spring being supported by the upper wall at an upper end, and supported by the screw fastener at a lower end, and resiliently urges the upper wall of the third connection member towards the second connection member.

6. The suction port assembly of claim 5, wherein the upper wall is angled with respect to an upper surface of the third connection member, and upon engagement between the second and third connection members, the upper wall is inserted in the first connection opening to block the first connection opening.

7. The suction port assembly of claim 1, wherein the suction head includes a second suction hole in the bottom surface thereof, and a connection recess disposed in the bottom surface which is in abutment with the suction holes.

8. The suction port assembly of claim 7, wherein the suction head includes a pair of inner flow passages formed in the suction head to connect the suction holes to the first connection members, with the pair of inner passages being isolated from each other in the suction head.

9. The suction port assembly of claim 7, wherein the suction head includes one or more suction grooves formed along an edge of the suction head in fluid communication with the connection recess.

10. A vacuum cleaner comprising:

a cleaner body housing a vacuum generator therein;

an extended flow passage connected to the cleaner body in fluid communication with the vacuum generator;

a suction head rotatably coupled at an end of the extended flow passage, and having a suction port which is connected in fluid communication with the extended flow passage; and an articulated portion connecting the suction head and the extended flow passage in a rotatable manner about a plurality of axes, wherein the articulated portion includes, a pair of first tubular connection members protruding from the suction head, a second connection member connected to the tubular connection members in a rotatable manner about a first axis, and a third connection member connected to the second connection member in a rotatable manner about a second axis, and connected with the extended flow passage, wherein the second connection member includes a first connector opening connected in fluid communication with the suction hole and located at the end which is connected with the third connection member, and a first connection boss extending from an inner sidewall of the second connection member toward the first connection opening, and having a screw-piercing hole at a lower end thereof.

11. The vacuum cleaner of claim 10, wherein the first axis is substantially parallel to a surface being cleaned, and the second axis is substantially parallel to a normal line of the surface being cleaned when the second connection member is rotated to a parallel position approximately parallel with respect to the surface being cleaned.

12. A suction port assembly of a vacuum cleaner for drawing in air and dust from a surface being cleaned when the vacuum cleaner is in operation, the suction port assembly being connected in fluid communication with a cleaner body through one or more extended flow passages which include at least one of an extension pipe and an extension hose, the suction port assembly comprising:

a suction head having a pair of suction holes formed at a bottom surface thereof opposite to the surface being cleaned and a connection recess in abutment with the pair of suction holes, and the suction head including a pair of inner flow passages formed in the suction head to connect the pair of suction holes to a pair of first connection members, with the pair of inner flow passages being isolated from each other in the suction head; and the pair of first connection members extending from one side of the suction head;

a second connection member rotatably connected at one end to an exit end of the first connection members and rotatable about a first axis to move upwardly and downwardly with respect to the suction head, and the other end of the second connection member being connected with the extended flow passage, wherein air is drawn in through the suction holes during the vacuum cleaning operation, passes through the first connection member and the second connection member and into the extended flow passage.

* * * * *